United States Patent [19]

Tanaka et al.

[11] Patent Number: 4,603,083

[45] Date of Patent: Jul. 29, 1986

[54] ULTRA-HIGH-TENACITY POLYVINYL ALCOHOL FIBER AND PROCESS FOR PRODUCING SAME

[75] Inventors: Hiroyoshi Tanaka; Mitsuo Suzuki; Fujio Ueda, all of Ehime, Japan

[73] Assignee: Toray Industries, Inc., Tokyo, Japan

[21] Appl. No.: 680,721

[22] Filed: Dec. 12, 1984

[30] Foreign Application Priority Data

Dec. 12, 1983 [JP] Japan ..... 58-232691
Dec. 12, 1983 [JP] Japan ..... 58-232692

[51] Int. Cl.[4] ..... D02G 3/00

[52] U.S. Cl. ..... 428/364; 264/210.8; 428/373

[58] Field of Search ..... 428/364; 264/185, 210.8; 525/56, 319

[56] References Cited

U.S. PATENT DOCUMENTS 4,138,445 2/1979 Nogi et al. ..... 525/58
4,440,711 4/1984 Kwon et al. ..... 264/185
4,478,971 10/1984 Ballard ..... 524/369

FOREIGN PATENT DOCUMENTS 43-16675 7/1968 Japan .
48-9209 3/1973 Japan .
56-128309 10/1981 Japan .

*Primary Examiner*—Lorraine T. Kendell
*Attorney, Agent, or Firm*—Armstrong, Nikaido, Marmelstein & Kubovcik

[57] ABSTRACT

An ultra-high-tenacity multifilament fiber of polyvinyl alcohol having a degree of polymerization of at least 1500, said filament having a tensile strength of at least 12 g/d and an initial modulus greater than 280 g/d, which is produced by a process for producing an ultra-high-tenacity polyvinyl alcohol fiber which comprises the steps of dissolving polyvinyl alcohol having a degree of polymerization of at least 1500 in a solvent, dry-spinning the resulting polymer solution through a spinneret into an environment of air or inert gas, introducing the dry-spun filaments into a coagulating bath, and drawing the coagulated filaments at a total effective draw ratio of at least 20 times.

7 Claims, 4 Drawing Figures

ULTRA-HIGH-TENACITY POLYVINYL ALCOHOL FIBER AND PROCESS FOR PRODUCING SAME

Background

The present invention relates to a new ultra-high-tenacity polyvinyl alcohol fiber (abbreviated as PVA fiber hereinafter) and a process for producing the same. More particularly, it relates to a PVA fiber which has incomparably better mechanical properties such as tensile strength and initial modulus than the conventional known PVA fiber, or even has ultra-high tenacity comparable to that of the aromatic polyamide fiber or aramid fiber, and to a process for producing the same.

PVA fiber is superior to polyamide fiber (nylon) and polyester fiber in mechanical properties (particularly modulus), resistance to sun light or outdoor exposure, and hydrophilic nature. Because of these characteristic properties, it finds a variety of uses in industrial applications such as fishing nets, tire cord, and cement reinforcement.

Such conventional PVA fiber is produced usually by the wet spinning process. According to this method, an aqueous solution of PVA is extruded from a spinneret into a coagulating bath such as a saturated aqueous solution of inorganic salt, in which the polymer solidifies to form filaments. The filaments then undergo washing, drawing, and drying, and finally acetalization that makes the filaments water-insoluble. In order to improve the mechanical strength of thus obtained PVA fiber, there have been proposed several methods. For example, according to Japanese Patent Publication No. 9209/1973, the polymer solution is incorporated with boric acid or a salt thereof, and according to Japanese Patent Laid-open No. 128309/1981, the wet-spun or dry-spun PVA filaments are drawn at least ten times and then heat-treated at a temperature higher than the drawing temperature under tension that keeps the filaments at a fixed length or permits the filaments to shrink up to 3%.

The PVA fiber produced by these processes is certainly improved in mechanical properties such as modulus over the conventional PVA fiber; but yet it does not attain the good mechanical properties comparable to those of aramid fiber.

The conventional process for producing PVA fiber has a disadvantage in that it requires acetalization to make the fiber water-insoluble. This step inevitably deteriorates the mechanical properties of the resulting PVA fiber.

A process for producing PVA fiber without the insolubilizing step was disclosed in Japanese Patent Publication No. 16675/1968. According to this disclosure, PVA is dissolved in dimethyl sulfoxide (abbreviated as DMSO hereinafter), and the resulting solution is extruded from a spinneret into a coagulating bath containing an organic solvent such as ethanol, methanol, benzene, and chloroform, or a mixture thereof with DMSO. The PVA fiber produced according to this process exhibits a certain degree of water-insolubility even though it does not undergo the above-mentioned insolubilizing step; nevertheless, it does not have water resistance satisfactory in practical use. Moreover, it is poor in mechanical properties. For example, its tensile strength is only about 10 g/d. Thus it is not regarded as a high-tenacity fiber comparable to aramid fiber.

OBJECTS OF THE INVENTION

It is an object of this invention to provide a PVA fiber having as ultra-high tenacity as aramid fiber which is unpredictable from the mechanical properties of the conventional PVA fiber.

It is another object of this invention to provide a PVA fiber having a new fiber structure which is associated with such an ultra-high tenacity.

It is still another object of this invention to provide a process for industrially producing such a PVA fiber having superior physical properties.

THE DRAWINGS

FIGS. 1(A) and 1(B) are photographs of wide-angle X-ray diffraction pattern and small-angle X-ray scattering pattern, respectively, of the ultra-high-tenacity PVA fiber obtained in Example 3 of this invention.

FIGS. 2(A) and 2(B) are photographs of wide-angle X-ray diffraction pattern and small-angle X-ray scattering pattern, respectively, of the conventional wet-spun PVA fiber obtained in Comparative Example 1.

DETAILED DESCRIPTION OF THE INVENTION

Figure 1A:
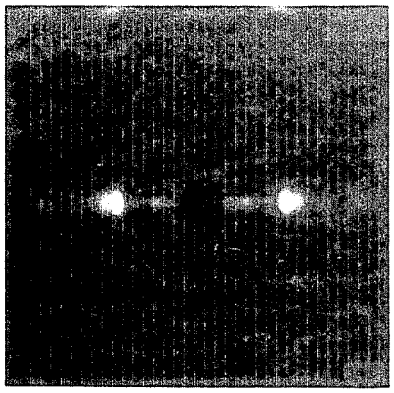

What is claimed in this invention is an ultra-high-tenacity PVA multifilament fiber which is composed of polyvinyl alcohol having a degree of polymerization of at least 1500 and has a tensile strength of at least 12 g/d and an initial modulus of at least 280 g/d.

The PVA fiber of this invention is characterized in that it is composed of high-molecular weight polyvinyl alcohol having a degree of polymerization of at least 1500, preferably at least 2500, more preferably at least 3100. Polyvinyl alcohol having such a high degree of polymerization varies in spinnability depending on the spinning process employed. Moreover, filaments spun from such polyvinyl alcohol vary in drawability to a great extent. Thus it is difficult to produce a PVA fiber having good properties derived from the high degree of polymerization of polyvinyl alcohol, and it is also difficult to produce a PVA multifilament fiber from polyvinyl alcohol having such a high degree of polymerization. The present inventors found that these difficulties can be overcome by the use of dry-jet wet spinning process mentioned later. According to this process, it is possible to produce PVA multifilaments which are very good in drawability. Thus the present inventors succeeded in producing a PVA fiber which has good properties derived from the high degree of polymerization of polyvinyl alcohol used as a raw material.

The ultra-high-tenacity PVA fiber of this invention cannot be produced by the wet spinning process which is commonly used for the production of PVA fibers, because the filaments spun by this process are so poor in drawability that the degree of orientation of PVA molecules in the direction of fiber axis is low. On the other hand, the ultra-high-tenacity PVA fiber of this invention cannot be produced either by the dry spinning process which is also used for the production of PVA fibers, because polyvinyl alcohol as a raw material has such a high degree of polymerization that it is difficult to prepare a polymer solution that can be spun into filaments in a stable manner. In addition, the dry spinning is difficult to achieve because the filaments extruding from the spinneret tend to adhere or stick to one another.

In contrast with these conventional spinning processes, the dry-jet wet spinning process of this invention permits the stable spinning of polyvinyl alcohol having a high degree of polymerization. According to this spinning process, the polymer solution is not extruded from a spinneret directly into a coagulating bath. Instead, the polymer solution is extruded through a layer of air or an inert gas such as nitrogen, helium, and argon, and subsequently the spun filaments are introduced into a coagulating bath. The thus produced filaments are capable of being drawn more than 20 times, or even 30 times.

The highly drawn PVA fiber of this invention has a tensile strength of at least 12 g/d, preferably at least 15 g/d, more preferably at least 17.5 g/d, and has an initial modulus of at least 280 g/d, preferably at least 300 g/d, more preferably at least 350 g/d. This strength is comparable to that of aramid fiber.

The PVA fiber of this invention apparently differs in fiber structure from the conventional PVA fiber. The difference is noticed in, for example, birefringence, long-period pattern of the small angle X-ray scattering, and crystallite size. (Birefringence represents the degree of orientation, in the direction of the axis of a fiber, of the polymer chains constituting a fiber. Long-period pattern of the small angle X-ray scattering represents the order structure formed by the repeating crystalline phase and amorphous phase in a fiber. Crystallite size is estimated by the wide-angle X-ray diffraction method.) The PVA fiber of this invention has such a unique fiber structure that the birefringence is greater than $50\times10^{-3}$, the long-period pattern does not appear in small-angle X-ray scattering, and the crystallite size estimated by wide-angle X-ray diffraction is greater than 60 Å.

As is apparent from the X-ray photographs in FIGS. 1(A) and 1(B) and FIGS. 2(A) and 2(B), the PVA fiber of this invention differs from the conventional one in that the crystallite size is greater than 60 Å when calculated according to Scherrer's equation from the half-width of the peak arising by diffraction from the (101) plane and that the long-period pattern is not detected.

The PVA fiber of this invention, which is a highly drawn fiber made of high-molecular weight polyvinyl alcohol, exhibits a birefringence greater than $50\times10^{-3}$ and has a residual elongation lower than 5%. Moreover, it is composed of a multiplicity of filaments, each having a fineness smaller than 10 denier (d), preferably smaller than 5 d, more preferably smaller than 3 d. The multifilament structure is possible to produce only when the above-mentioned dry-jet wet spinning process is employed, which prevents individual filaments from adhering or sticking to one another during the spinning process. In addition, the multifilament structure permits the PVA fiber to be fabricated into a variety of products through many steps.

In what follows, we will describe in more detail the process for producing the ultra-high-tenacity PVA fiber of this invention.

The polyvinyl alcohol from which the PVA fiber of this invention is produced is not specifically restricted so long as it has a degree of polymerization within the above-mentioned range which permits the polymer to be formed into fiber. It comprehends partially saponified (hydrolyzed) PVA, completely saponified PVA, and PVA copolymers containing a small amount of vinyl monomer copolymerizable with vinyl alcohol.

The solvent for the polyvinyl alcohol includes organic solvents such as dimethyl sulfoxide (DMSO), glycerin, ethylene glycol, diethylene triamine, ethylene diamine, and phenol; and aqueous solutions of inorganic salt such as zinc chloride, sodium thiocyanate, calcium chloride, and aluminum chloride; and a mixture thereof. Preferable among them are DMSO, glycerin, ethylene glycol, diethylene triamine, and ethylene diamine which dissolve the polymer very well. Most preferable among them is DMSO.

The solution of polyvinyl alcohol in one of the above-mentioned solvents should be adjusted to a proper concentration and temperature according to the degree of polymerization of the polymer and the spinning conditions employed, so that it has a viscosity of 100 to 5000 poise, preferably 200 to 2000 poise, as measured when it emerges from the spinneret. If the viscosity is lower than 100 poise, it is difficult to perform the dry-jet wet spinning in a stable manner. On the other hand, if the viscosity is higher than 5000 poise, the polymer solution becomes poor in spinnability.

According to the dry-jet wet spinning process of this invention, the distance between the face of the spinneret and the liquid level of the coagulating bath is 2 to 200 mm, preferably 3 to 20 mm. If the distance is shorter than the lower limit, it is difficult to perform the dry-jet wet spinning in a stable manner. On the other hand, if the distance is greater than the upper limit, the filaments tend to break and stick to one another.

The polymer solution is extruded through a layer of air or inert gas to form filaments therein. The spun filaments are then introduced into a coagulating bath in which the polymer solidifies. The liquid in the coagulating bath is an alcohol such as methanol, ethanol, and butanol; and acetone, benzene, and toluene; and a mixture thereof with DMSO; or a saturated aqueous solution of inorganic salt. Preferable among them are methanol, ethanol, and acetone.

After coagulation, the filaments undergoes desolvation, drying, and drawing. According to this invention, the filaments should be stretched more than 20 times, preferably more than 30 times. This high draw ratio imparts the above-mentioned outstanding properties and new fiber structure to the PVA fiber of this invention. In other words, the dry-jet wet spinning process of this invention is the only way of producing the filaments that can be drawn at a high ratio.

The drawing is usually accomplished in at least two stages, and the drawing in the second stage should preferably be accomplished under dry heat conditions at 200 to 250° C. For example the drawing in this manner makes it possible to draw filaments made from polyvinyl alcohol having a degree of polymerization of 3100 more than 30 times in total and drawn filaments have a tensile strength higher than 18 g/d and an initial modulus of 400 g/d, which are comparable to those of aramid fiber.

The invention is now described in more detail with reference to the examples. Following is a description of the methods employed in the examples to measure the birefringence, small-angle X-ray scattering, wide-angle X-ray diffraction, tensile strength, and initial modulus.

Birefringence: This indicates the degree of orientation of the polymer chains in the direction of fiber axis. It is defined by the difference between two refractive indices, one measured with polarized light vibrating in the direction parallel to the fiber axis and the other measured with polarized light vibrating in the direction perpendicular to the fiber axis. It was measured according to the Berek compensator method by using a polarizing microscope (made by Nippon Kogaku K.K.) and white light as a light source.

Tensile strength and initial modulus: These physical properties were measured according to the method provided in JIS L-1017 by using a filament at the specimen. No corrections are made to compensate for the decrease in denier of the specimen that takes place during measurement, in reading the data on tensile strength at break and initial modulus (initial tensile resistance) obtained from the load-elongation curve. The load-elongation curve was recorded under the following testing conditions. A 25-cm long specimen is taken from PVA fiber in the form of hank which has been conditioned for 24 hours at 20° C. and 65% RH. The specimen is pulled at a rate of 30 cm/min on a "Tensilon" tensile tester, Model UTM-4L, made by Toyo Baldwin Co., Ltd. Initial modulus was calculated from the thus obtained load-elongation curve according to the definition in JIS L-1017.

Wide-angle X-ray diffraction: Experiments were carried out according to the method described in "X-ray Diffraction of Polymers" written by Masao Tsunoda et al (Maruzen, 1968), under the following conditions.

Cu Kα line (with Ni filter)
Output: 35 kV–15 mA
1 mm pinhole collimator; transmission method
Camera radius: about 40 mm
Exposure: 20 minutes
Film: Kodak no-screen type The crystallite size was calculated from the half-width of the peak arising by diffraction from the (101) plane according to Scherrer's equation.

$$L\,(hkl) = K\lambda/\beta_o\cos\theta$$

where L (hkl) is the average size of crystallites in the direction perpendicular to the (hkl) plane.

$\beta_o^2 = \beta_e^2 - \beta_i^2$
$\beta_e$: apparent half-width
$\beta_i$: $1.05\times10^{-2}$ rad
K: 1.0
λ: wavelength of X-ray
θ: Bragg angle Small-angle X-ray scattering: Measured under the following conditions according to the known method that employs a Kiessing camera.

Apparatus: X-ray generator, Model RU-200, made by Rigaku Denki K.K.
Cu Kα line (with Ni filter)
Output: 50 kV–150 mA
0.3 mm collimator; transmission method
Camera radius: about 400 mm
Exposure: 90 minutes
Film: Kodak no-screen type

EXAMPLE 1

Completely saponified (hydrolyzed) polyvinyl alcohol having a degree of polymerization of 2600 was dissolved in DMSO to give a 15 wt % polymer solution. This polymer solution underwent dry-jet wet spinning which employed a spinneret having 50 holes, each 0.08 mm in diameter, and a coagulating bath of methanol containing 10 wt % DMSO. The distance between the face of the spinneret and the liquid level of the coagulating bath was 5 mm.

The resulting filaments were washed with methanol to remove DMSO therefrom and then underwent hot drawing in a hot tube (purged with nitrogene) at 220° C. The maximum draw ratio was 26.5 times. The properties of the drawn single filament were as follows:

Fineness: 1.8 d
Cross-section: round
Tensile strength: 17.6 g/d
Elongation: 3.9%
Initial modulus: 405 g/d
Birefringence: $54\times10^{-3}$
Crystallite size measured by wide-angle X-ray diffraction: 61 Å
Long-period pattern due to small-angle X-ray scattering was not observed.

For the purpose of comparison, the above-mentioned polymer solution was made into filaments by the conventional wet spinning. The maximum draw ratio attained was 19.6 times. The properties of the drawn single filament were as follows:

Fineness: 2.7 d
Cross-section: round
Tensile strength: 10.8 g/d
Elongation: 4.1%
Initial modulus: 280 g/d
Birefringence: $47\times10^{-3}$
Crystallite size measured by wide-angle X-ray diffraction: 50 Å
Long-period pattern due to small-angle X-ray scattering: 167 Å

EXAMPLE 2

Four kinds of completely saponified polyvinyl alcohol, each having a degree of polymerization of 1200, 1800, 3500, and 4000, were dissolved in DMSO to give four polymer solutions, each having a concentration of 20 wt %, 17 wt %, 12 wt %, and 9 wt %. Each of these polymer solutions underwent dry-jet wet spinning that employed a spinneret of the same type as in Example 1 and a coagulating bath of methanol containing 5 wt % DMSO. The distance between the face of the spinneret and the liquid level of the coagulating bath was 3 mm.

The resulting filaments were washed with methanol to remove DMSO therefrom and then underwent hot drawing in a hot tube at 200 to 220° C.

Table 1 shows the maximum draw ratio and the properties of each of the drawn single filaments, together with those of drawn filaments obtained by the conventional wet spinning process.

TABLE 1

| Degree of polymerization | Spinning process | Maximum draw ratio (times) | Tensile strength (g/d) | Initial modulus (g/d) | Elongation (%) |
|---|---|---|---|---|---|
| 1200 | Dry-jet Wet | 18.2 | 11.5 | 265 | 5.1 |
| 1800 | " | 23.2 | 15.5 | 356 | 4.2 |
| 3500 | " | 29.4 | 19.2 | 420 | 3.9 |
| 4000 | " | 30.1 | 19.6 | 445 | 3.8 |
| 1200 | Conv. Wet | 13.5 | 9.5 | 223 | 6.5 |
| 1800 | " | 18.2 | 11.2 | 260 | 5.2 |
| 3500 | " | 17.6 | 11.7 | 281 | 5.4 |
| 4000 | " | 16.3 | 12.9 | 305 | 5.8 |

EXAMPLE 3

Completely saponified polyvinyl alcohol having a degree of polymerization of 4300 was dissolved in DMSO to give a 9 wt % polymer solution. This polymer solution underwent dry-jet wet spinning that employed a spinneret of the same type as in Example 1 and employed coagulating bath of 100% methanol. The distance between the face of the spinneret and the liquid level of the coagulating bath was 10 mm.

The resulting filaments obtained were drawn 6 times while washing with methanol. After drying, they were further drawn 5.1 times in a hot tube at 230° C.

Figure 1B:
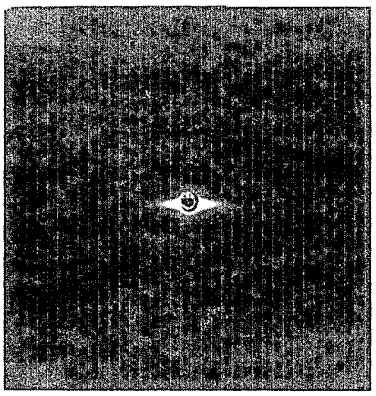

The maximum draw ratio was 30.6 times. The properties of the drawn single filament were as follows:

Fineness: 2.2 d
Cross-section: round
Tensile strength: 20.2 g/d
Elongation: 3.8%
Initial modulus: 450 g/d
Birefringence: $56\times10^{-3}$
Wide-angle X-ray diffraction pattern and small-angle X-ray scattering pattern are as shown in FIGS. 1(A) and 1(B).
Crystallite size measured by wide-angle X-ray diffraction: 63 Å
Long-period pattern due to small-angle X-ray scattering was not observed.

EXAMPLE 4

Completely saponified polyvinyl alcohol having a degree of polymerization of 2600 was dissolved in DMSO to give a 16 wt % polymer solution. This polymer solution underwent dry-jet wet spinning that employed a spinneret having 20 holes, each 0.10 mm in diameter, and a coagulating bath of methanol. The distance between the face of the spinneret and the liquid level of the coagulating bath was 5 mm.

The resulting filaments were washed with methanol. After drying, they underwent hot drawing in a hot tube at 210° to 230° C. in two different draw ratios.

Table 2 shows the draw ratio and the properties of each of the drawn single filaments.

TABLE 2

| Draw ratio (times) | Crystallite size (Å) | Long period (Å) | Birefringence $\times 10^{-3}$ | Water resistance* | Tensile strength (g/d) | Initial modulus (g/d) |
|---|---|---|---|---|---|---|
| 10 | 57 | 220 | 45 | soluble | 11.8 | 210 |
| 21 | 62 | none | 55 | insoluble | 17.6 | 405 |

*Water resistance was examined by immersing the drawn filaments in boiling water for 30 minutes.

COMPARATIVE EXAMPLE 1

Completely saponified polyvinyl alcohol having a degree of polymerization of 1800 was dissolved in water to give a 17 wt % polymer solution. This polymer solution was made into filaments by the known wetspinning process that employed a coagulating bath of saturated aqueous solution of sodium sulfate.

Figure 2A:
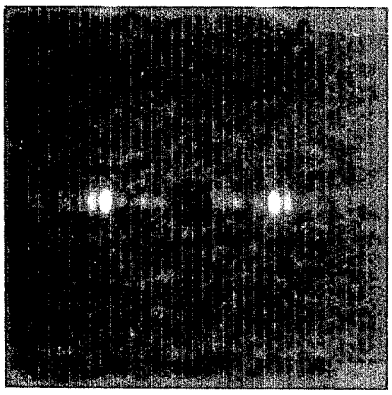
Figure 2B:
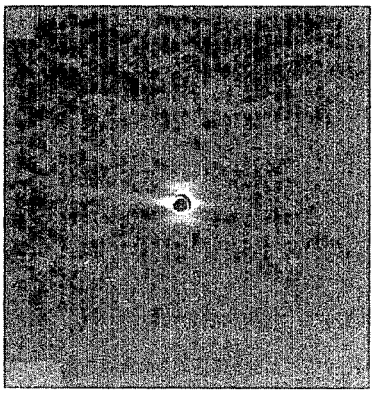

The maximum draw ratio attained was 9.6 times. The properties of each of the drawn single filaments were as follows:

Fineness: 6.0 d
Cross-section: U-shaped
Tensile strength: 7.6 g/d
Elongation: 8.5%
Initial modulus: 120 g/d
Birefringence: Impossible to measure accurately due to the U-shaped cross-section.
Wide-angle X-ray diffraction pattern and small-angle X-ray scattering pattern are as shown in FIGS. 2(A) and 2(B).
Crystallite size measured by wide-angle X-ray diffraction: 46 Å
Long-period pattern due to small-angle X-ray scattering: 197 Å

EXAMPLE 5

Completely saponified polyvinyl alcohol having a degree of polymerization of 4500 was dissolved in glycerin at 200° C. to give a 9 wt % polymer solution. This polymer solution kept at 200° C. underwent dry-jet wet spinning that employed a spinneret having 20 holes, each 0.12 mm in diameter, and a coagulating bath of methanol. The distance between the face of the spinneret and the liquid level of the coagulating bath was 10 mm.

The resulting filaments were washed with methanol to remove glycerin therefrom. After drying, they underwent hot drawing in a hot tube at 220° to 240° C. The maximum draw ratio was 30.7 times. The properties of the drawn single filament were as follows:

Fineness: 2.5 d
Cross-section: round
Tensile strength: 20.2 g/d
Elongation: 3.7%
Initial modulus: 480 g/d
Birefringence: $56\times10^{-3}$
Crystallite size measured by wide-angle X-ray diffraction: 63 Å
Long-period pattern due to small-angle X-ray scattering was not observed.

EXAMPLE 6

Completely saponified PVA having 3500 for the polymerization degree was dissolved in DMSO to prepare three polymer solutions different in viscosity, having 5 wt %, 12 wt % and 25 wt % for the polymer concentration, and with use of the same spinneret as in Example 1, the respective polymer solutions were subjected to dry-jet wet spinning in a coagulating bath of methanol at the spinning temperature of 80° C. The distance between the face of the spinneret and the liquid level of the coagulating bath was set at 5 mm. The following Table 3 enters the viscosity at 80° C. and the spinnability found of each polymer solution.

TABLE 3

| Polymer Concentration (wt %) | Viscosity at 80° C. (poise) | Spinnability |
|---|---|---|
| 5 | 30 | The solution underwent dripping along the spinneret face; spinning infeasible. |
| 12 | 350 | Satisfactory |
| 25 | 7500 | Frequent was monofilament cut on the spinneret face. |

EXAMPLE 7

Completely saponified PVA having 3500 for the polymerization degree was dissolved in DMSO to prepare a 12 wt % polymer solution, and using the same spinneret as in Example 1, it was subjected to dry-jet wet spinning in a methanol coagulating bath at varied distances between the face of the spinneret and the liquid level of the coagulating bath. The following Table 4 shows the spinnability then found.

TABLE 4

| Distance between the spinneret face and the bath liquid level (mm) | Spinnability |
|---|---|
| 1 | The spinneret face and the liquid level of the coagulating bath became contacting together, and a wet spinning took place. |
| 5 | Satisfactory |
| 20 | Satisfactory |
| 300 | Mutual sticking occurred among extruded filaments. |

We claim:

1. An ultra-high tenacity filament of polyvinyl alcohol having a degree of polymerization of at least 1500, a fineness lower than 10 deniers, a residual elongation lower than 5%, a tensile strength of at least 12 g/d and an initial modulus of at least 280 g/d.

2. An ultra-high-tenacity polyvinyl alcohol filament as claimed in claim 1, which is produced by the dry-jet wet spinning process.

3. An ultra-high-tenacity polyvinyl alcohol filament as claimed in claim 1, which has a tensile strength of at least 15 and an initial modulus of at least 300 g/d.

4. An ultra-high-tenacity polyvinyl alcohol filament as claimed in claim 1, which is produced from polyvinyl alcohol having a degree of polymerization of at least 2500 and has a tensile strength of at least 17.5 g/d and an initial modulus of at least 350 g/d.

5. An ultra-high-tenacity polyvinyl alcohol filament as claimed in claim 1, which has birefringence of at least $50\times10^{-3}$ and has no long-period patterns arising from small-angle X-ray scattering.

6. An ultra-high-tenacity polyvinyl alcohol filament as claimed in claim 1, having a fineness lower than 5 deniers.

7. An ultra-high-tenacity polyvinyl alcohol filament as claimed in claim 1, having a fineness lower than 3 deniers and a round or oval cross-section.

* * * * *